US008410042B2

(12) United States Patent
Moretti

(10) Patent No.: US 8,410,042 B2
(45) Date of Patent: Apr. 2, 2013

(54) ODORANTS WITH ANISIC NOTES

(75) Inventor: Robert Moretti, Grand-Lancy (CH)

(73) Assignee: Firmenich SA, Geneva (CH)

( * ) Notice: Subject to any disclaimer, the term of this patent is extended or adjusted under 35 U.S.C. 154(b) by 0 days.

(21) Appl. No.: 13/501,029

(22) PCT Filed: Sep. 28, 2010

(86) PCT No.: PCT/IB2010/054352

§ 371 (c)(1),
(2), (4) Date: Apr. 9, 2012

(87) PCT Pub. No.: WO2011/051834

PCT Pub. Date: May 5, 2011

(65) Prior Publication Data

US 2012/0208741 A1 Aug. 16, 2012

(30) Foreign Application Priority Data

Nov. 2, 2009 (EP) ..... 09174727

(51) Int. Cl.
*A61Q 13/00* (2006.01)

(52) U.S. Cl. ..... 512/20

(58) Field of Classification Search ..... 512/20
See application file for complete search history.

(56) References Cited

U.S. PATENT DOCUMENTS

| | | | | |
|---|---|---|---|---|
| 4,524,021 | A | 6/1985 | Wiegers et al. | 252/522 R |
| 4,767,768 | A | 8/1988 | Okamoto et al. | 514/315 |
| 4,772,583 | A | 9/1988 | Sprecker et al. | 512/12 |
| 4,985,402 | A | 1/1991 | Narula et al. | 512/6 |
| 5,491,233 | A | 2/1996 | Buchwald et al. | 544/174 |
| 2006/0014664 | A1 | 1/2006 | Goeke | 512/8 |
| 2010/0069508 | A1 | 3/2010 | Bajgrowicz | 514/772 |

FOREIGN PATENT DOCUMENTS

| | | | | |
|---|---|---|---|---|
| EP | 0 113 106 | B1 | | 7/1984 |
| JP | 03081202 | A | * | 4/1991 |
| WO | WO 2004/056765 | A1 | | 7/2004 |
| WO | WO 2008/052379 | A2 | | 5/2008 |

OTHER PUBLICATIONS

International Search Report and Written Opinion of the International Searching Authority, application No. PCT/IB2010/054352, dated Jan. 26, 2011.

S. Arctander, "1950: alpha-Methylcinnamic Alcohol," Perfume and Flavor Chemicals, Allured Publishing Corporation (1969).

S. Arctander, "2110: alpha-Methyl-3,4-Methylene-Dioxy Hydrocinnamic Aldehyde," Perfume and Flavor Chemicals, Allured Publishing Corporation (1969).

Bogert et al., "The Synthesis of Simple and of Substituted 2-Alkylcinnamic Alcohols, Including a Monomolecular Cubebin," J. Am. Chem. Soc., 53(4):1605-1609 (1931).

Schomaker et al., "Diastereomerically and Enantiomerically Pure 2,3-Disubstituted Pyrrolidines from 2,3-Aziridin-1-ols Using a Sulfoxonium Ylide: A One-Carbon Homologative Relay Ring Expansion," J. Am. Chem. Soc., 129:1996-2003 (2007).

Tay et al., "Phosphonates α-Lithies Agents de Transfert Fonctionnel. Preparation D'Aldehydes α, β-Insatures α-Substitutes," Tetrahedron Letters, 28(12):1263-1266 (1987) (English abstract).

* cited by examiner

*Primary Examiner* — Ling Choi
*Assistant Examiner* — Lanee Reuther
(74) *Attorney, Agent, or Firm* — Winston & Strawn LLP

(57) ABSTRACT

The present invention concerns the use as perfuming ingredients of para-substituted derivatives of α-methyl cinnamic alcohol of formula (I) in the form of any one of its stereoisomers or a mixture thereof, and wherein R represents a hydrogen atom, a $C_{1-4}$ alkyl or alkenyl group or a formyl or acetyl group; $R^1$ represents a hydrogen atom or a methyl group; $R^2$ represents a methyl, ethyl or methoxy group; and $R^3$ represents a $CH_2$ group or a carbon-carbon double bond. The present invention concerns the use of said compound in the perfumery industry as well as the compositions or articles containing said compound.

(I)

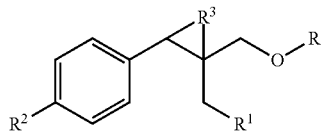

10 Claims, No Drawings

ODORANTS WITH ANISIC NOTES

This application is a 371 filing of International Patent Application PCT/IB2010/054352, filed Sep. 28, 2010.

TECHNICAL FIELD

The present invention relates to the field of perfumery. More particularly, it concerns the use as perfuming ingredients of para-substituted derivatives of α-methyl cinnamic alcohol according to formula (I) herein below.

The present invention concerns the use of said compounds in the perfumery industry as well as the compositions or articles containing said compounds.

PRIOR ART

Some of the compounds of the present invention are known from the prior art. For instance, (E)-1-methoxy-4-(3-methoxy-2-methyl-1-propenyl)-benzene (e.g. see U.S. Pat. No. 5,491,233), 2-methyl-3-(4-methylphenyl)-2-propen-1-ol and its configuration isomers (e.g. see JACS, 1931, 53), (E)-2-[(4-methoxyphenyl)methylene]-1-butanol (e.g. see EP 113106), 3-(4-methoxyphenyl)-2-methyl-2-propen-1-ol and its configuration isomers (e.g. see JACS, 2007, 129, 1996), have been reported all as chemical intermediates only.

However, none of the prior art documents reporting an invention's compound mentions or suggests any organoleptic properties of the compounds of formula (I), or any use of said compound in the field of perfumery.

The known perfuming ingredient having the closest chemical structure is α-methylcinnamic alcohol (Arctander book's n° 1950). However this compound possesses totally different odor properties and does not suggest any organoleptic properties of the compounds of formula (I), or any use of said compounds in the field of perfumery.

DESCRIPTION OF THE INVENTION

We have now surprisingly discovered that a compound of formula (I)

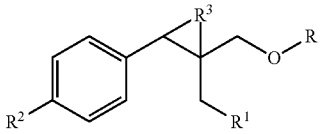

in the form of any one of its stereoisomers or a mixture thereof, and wherein R represents a hydrogen atom, a $C_{1-4}$ alkyl or alkenyl group or a formyl or acetyl group;

$R^1$ represents a hydrogen atom or a methyl group;

$R^2$ represents a methyl, ethyl or methoxy group; and $R^3$ represents a $CH_2$ group or a carbon-carbon double bond;

can be used as perfuming ingredient, for instance to impart odor notes of the anisic type and in a particular embodiment of the invention to impart odor notes of the anisic and floral type.

According to a particular embodiment of the invention said compound (I) is of formula (II)

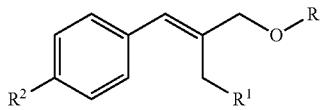

in the form of any one of its stereoisomers or a mixture thereof, and wherein R represents a hydrogen atom, a $C_{1-4}$ alkyl or alkenyl group or a formyl or acetyl group;

$R^1$ represents a hydrogen atom or a methyl group; and $R^2$ represents a methyl, ethyl or methoxy group.

For the sake of clarity, by the expression "$R^3$ represents a . . . carbon-carbon double bond", or the similar, it is meant the normal meaning understood by a person skilled in the art, i.e. that the whole bonding (solid and dotted lines) between the carbon atoms connected by said $R^3$ is a carbon-carbon double bond.

According to any one of the above embodiments of the invention, R represents a hydrogen atom, an allyl group, a methyl group or a formyl or acetyl group. In particular R represents a hydrogen atom or an allyl group.

According to any one of the above embodiments of the invention, $R^1$ represents a hydrogen atom.

According to any one of the above embodiments of the invention, $R^2$ represents a methyl or methoxy group. In particular $R^2$ represents a methyl group.

According to any one of the above embodiments of the invention, said compounds (I) are $C_{11}$-$C_{14}$ compounds.

As specific examples of the invention's compounds, one may cite, as non-limiting example, (2E)-2-methyl-3-(4-methylphenyl)-2-propen-1-ol which possesses an odor characterized by a nice and natural floral-powdery note as well as an anisic note. The whole evoking the linden leaves or flowers. This floral note distinguishes itself from the rest of the anisic olfactive family (e.g. anisic aldehyde, 2-methyl-3-(4-methoxyphenyl)propanal or 3-(1,3-benzodioxol-5-yl)-2-methylpropanal) by having an odor less aldehydic, more natural and by irresistibly evoking linden.

The odor of (2E)-2-methyl-3-(4-methylphenyl)-2-propen-1-ol is also clearly distinguished from the one of its closest structural analogue known in perfumery, i.e. α-methylcinnamic alcohol (Arctander n° 1950). Indeed when the odor of the invention's compounds is compared with the one of the prior art, then the invention's compound distinguishes itself by a clear floral-anisic note (absent in the prior art compound) and by lacking the cinnamic/styrax note so characteristic of the prior art compound.

As other example one may cite 1-[(1E)-3-(allyloxy)-2-methyl-1-propenyl]-4-methylbenzene, which possesses an odor having an anisic-pastis note as well as a floral note of the lily of the valley/hyacinth and green type.

As other specific, but non-limiting, examples of the invention's compounds, one may cite the following ones in Table 1:

TABLE 1

Invention's compounds and their odor properties

| Compound structure and name | Odor notes |
|---|---|
| 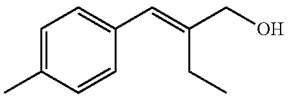 (2E)-2-ethyl-3-(4-methylphenyl)-2-propen-1-ol | Floral, anisic, anisic alcohol |
| 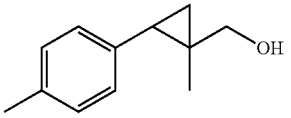 (1-methyl-2-p-tolyl-cyclopropyl)methanol | Anisic, mimosa, slightly powdery, very pleasant and balanced |
| 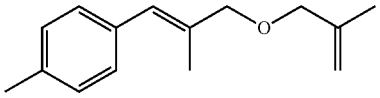 1-methyl-4-{(1E)-2-methyl-3-[(2-methyl-2-propenyl)oxy]-1-propenyl}benzene | Anisic, anisyl esters, and slightly floral |
| 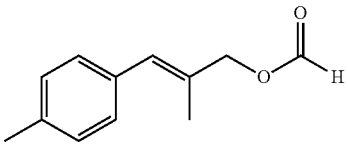 (2E)-2-methyl-3-(4-methylphenyl)-2-propenyl formate | Anisic and slightly floral |
| 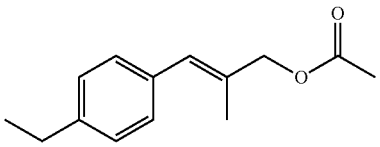 (2E)-3-(4-ethylphenyl)-2-methyl-2-propenyl acetate | Anisic, fruity and slightly floral |

According to a particular embodiment of the invention, the compounds of formula (I) are (2E)-2-methyl-3-(4-methylphenyl)-2-propen- 1-ol, (1-methyl-2-p-tolylcyclopropyl) methanol or 1-[(1E)-3-(allyloxy)-2-methyl- 1-propenyl]-4-methylbenzene.

Therefore the present invention's compounds either have a very different structure compared to the prior art compounds having a similar odor, or have a similar structure to other prior art compounds but possess an odor totally different from the odor of the latter. Indeed the invention's compounds do not impart cinnamon odor notes, as their prior art structural analogue.

Said differences lend the invention's compounds and the similar prior art compounds to be each suitable for different uses, i.e. to impart different organoleptic impressions.

As mentioned above, the invention concerns the use of a compound of formula (I) as perfuming ingredient. In other words it concerns a method to confer, enhance, improve or modify the odor properties of a perfuming composition or of a perfumed article, which method comprises adding to said composition or article an effective amount of at least a compound of formula (I). By "use of a compound of formula (I)" it has to be understood here also the use of any composition containing compound (I) and which can be advantageously employed in perfumery industry as active ingredients.

Said compositions, which in fact can be advantageously employed as perfuming ingredient, are also an object of the present invention.

Therefore, another object of the present invention is a perfuming composition comprising:

i) as perfuming ingredient, at least one invention's compound as defined above;

ii) at least one ingredient selected from the group consisting of a perfumery carrier and a perfumery base; and iii) optionally at least one perfumery adjuvant.

By "perfumery carrier" we mean here a material which is practically neutral from a perfumery point of view, i.e. that does not significantly alter the organoleptic properties of perfuming ingredients. Said carrier may be a liquid or a solid.

As liquid carrier one may cite, as non-limiting examples, an emulsifying system, i.e. a solvent and a surfactant system, or a solvent commonly used in perfumery. A detailed description of the nature and type of solvents commonly used in perfumery cannot be exhaustive. However, one can cite as non-limiting example solvents such as dipropyleneglycol, diethyl phthalate, isopropyl myristate, benzyl benzoate, 2-(2-ethoxyethoxy)-1-ethanol or ethyl citrate, which are the most commonly used.

As solid carrier one may cite, as non-limiting examples, absorbing gums or polymers, or yet encapsulating materials. Examples of such materials may comprise wall-forming and plasticizing materials, such as mono, di- or trisaccharides, natural or modified starches, hydrocolloids, cellulose derivatives, polyvinyl acetates, polyvinylalcohols, proteins or pectins, or yet the materials cited in reference texts such as H. Scherz, Hydrokolloids: Stabilisatoren, Dickungs- and Gehermittel in Lebensmittel, Band 2 der Schriftenreihe Lebensmittelchemie, Lebensmittelqualitat, Behr's VerlagGmbH & Co., Hamburg, 1996. The encapsulation is a well known process to a person skilled in the art, and may be performed, for instance, using techniques such as spray-drying, agglomeration or yet extrusion; or consists of a coating encapsulation, including coacervation and complex coacervation techniques.

By "perfumery base" we mean here a composition comprising at least one perfuming co-ingredient.

Said perfuming co-ingredient is not of the formula (I). Moreover, by "perfuming co-ingredient" it is meant here a compound, which is used in perfuming preparation or composition to impart a hedonic effect. In other words such a co-ingredient, to be considered as being a perfuming one, must be recognized by a person skilled in the art as being able to impart or modify in a positive or pleasant way the odor of a composition, and not just as having an odor.

The nature and type of the perfuming co-ingredients present in the base do not warrant a more detailed description here, which in any case would not be exhaustive, the skilled person being able to select them on the basis of its general knowledge and according to intended use or application and the desired organoleptic effect. In general terms, these perfuming co-ingredients belong to chemical classes as varied as alcohols, lactones, aldehydes, ketones, esters, ethers, acetates, nitriles, terpenoids, nitrogenous or sulphurous heterocyclic compounds and essential oils, and said perfuming co-ingredients can be of natural or synthetic origin. Many of these co-ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said co-ingredients may also be compounds known to release in a controlled manner various types of perfuming compounds.

For the compositions which comprise both a perfumery carrier and a perfumery base, other suitable perfumery carrier, than those previously specified, can be also ethanol, water/ethanol mixtures, limonene or other terpenes, isoparaffins such as those known under the trademark Isopar® (origin: Exxon Chemical) or glycol ethers and glycol ether esters such as those known under the trademark Dowanol® (origin: Dow Chemical Company).

By "perfumery adjuvant" we mean here an ingredient capable of imparting additional added benefit such as a color, a particular light resistance, chemical stability, etc. A detailed description of the nature and type of adjuvant commonly used in perfuming bases cannot be exhaustive, but it has to be mentioned that said ingredients are well known to a person skilled in the art.

An invention's composition consisting of at least one compound of formula (I) and at least one perfumery carrier represents a particular embodiment of the invention as well as a perfuming composition comprising at least one compound of formula (I), at least one perfumery carrier, at least one perfumery base, and optionally at least one perfumery adjuvant.

It is useful to mention here that the possibility to have, in the compositions mentioned above, more than one compound of formula (I) is important as it enables the perfumer to prepare accords, perfumes, possessing the odor tonality of various compounds of the invention, creating thus new tools for their work.

For the sake of clarity, it is understood that by the expression "perfuming composition" it is understood a composition which is in a suitable form to be used in perfumery. Therefore, any composition or any mixture resulting directly from a chemical synthesis, e.g. without an adequate purification, in which the compound of the invention would be involved as a starting, intermediate or end-product could not be considered as a perfuming composition according to the invention. Similarly, a composition which comprises the invention's compounds as well as other components which are not used in or not compatible with the perfumery, such as kerosine, are also excluded from the present invention.

Furthermore, the invention's compound can also be advantageously used in all the fields of modern perfumery, i.e. fine or functional perfumery, to positively impart or modify the odor of a consumer product into which said compound (I) is added. Consequently, a perfuming consumer product which comprises:

i) as perfuming ingredient, at least one compound of formula (I), as defined above; and ii) a perfumery consumer base; is also an object of the present invention.

The invention's compound can be added as such or as part of an invention's perfuming composition.

For the sake of clarity, it has to be mentioned that, by "perfuming consumer product" it is meant a consumer product which is expected to deliver at least a perfuming effect, in other words it is a perfumed consumer product. For the sake of clarity, it has to be mentioned that, by "perfumery consumer base" we mean here the functional formulation, as well as optionally additional benefit agents, corresponding to a consumer product which is compatible with perfuming ingredients and is expected to deliver a pleasant odor to the surface to which it is applied (e.g. skin, hair, textile, or home surface). In other words, a perfuming consumer product according to the invention comprises the functional formulation, as well as optionally additional benefit agents, corresponding to the desired consumer product, e.g. a detergent or an air freshener, and an olfactive effective amount of at least one invention's compound.

The nature and type of the constituents of the perfumery consumer base do not warrant a more detailed description here, which in any case would not be exhaustive, the skilled person being able to select them on the basis of its general knowledge and according to the nature and the desired effect of said product.

Non-limiting examples of suitable perfumery consumer bases can be a perfume, such as a fine perfume, a cologne or an after-shave lotion; a fabric care product, such as a liquid or solid detergent, a fabric softener, a fabric refresher, an ironing water, a paper, or a bleach; a body-care product, such as a hair care product (e.g. a shampoo, a coloring preparation or a hair spray), a cosmetic preparation (e.g. a vanishing cream or a deodorant or antiperspirant), or a skin-care product (e.g. a perfumed soap, shower or bath mousse, oil or gel, or a hygiene product); an air care product, such as an air freshener or a "ready to use" powdered air freshener; or a home care product, such as a wipe, a dish detergent or hard-surface detergent.

Some of the above-mentioned consumer product bases may represent an aggressive medium for the invention's compound, so that it may be necessary to protect the latter from premature decomposition, for example by encapsulation or by chemically bounding it to another chemical which is suitable to release the invention's ingredient upon a suitable external stimulus, such as an enzyme, light, heat or a change of pH.

The proportions in which the compounds according to the invention can be incorporated into the various aforementioned articles or compositions vary within a wide range of values. These values are dependent on the nature of the article to be perfumed and on the desired organoleptic effect as well as the nature of the co-ingredients in a given base when the compounds according to the invention are mixed with perfuming co-ingredients, solvents or additives commonly used in the art.

For example, in the case of perfuming compositions, typical concentrations are in the order of 0.1% to 30% by weight, or even more, of the compounds of the invention based on the weight of the composition into which they are incorporated. Concentrations lower than these, such as in the order of 0.01% to 10% by weight, can be used when these compounds are incorporated into perfumed articles, percentage being relative to the weight of the article.

The invention's compounds can be prepared according to methods as described herein below in the Examples.

EXAMPLES

The invention will now be described in further detail by way of the following examples, wherein the abbreviations have the usual meaning in the art, the temperatures are indicated in degrees centigrade (° C.); the NMR spectral data were recorded in $CDCl_3$ (if not stated otherwise) with a 360 or 400 MHz machine for $^1H$ and $^{13}C$, the chemical shifts δ are indicated in ppm with respect to TMS as standard, the coupling constants J are expressed in Hz.

Example 1

Synthesis of Compounds of Formula (I)

(2E)-2-methyl-3-(4-methylphenyl)-2-propen-1-ol (2E)-2-methyl-3-(4-methylphenyl)-2-propenal (320 g, 2 mol, described in Tet. Let., 28, 1987, 1263) was dissolved under nitrogen in dry THF (1 liter). The solution was cooled in an ice-water bath and solid lithium aluminum hydride (25 g, 0.63 mol) was added portion-wise at a rate such as to maintain the internal temperature below 20° C. The cooling bath was removed and the reaction stirred for 3 hours. It was then recooled in an ice-water bath. Water (25 ml) was added slowly to the reaction, followed by 5% aqueous NaOH (75 ml) and more water (25 ml). The cooling bath was removed and the reaction stirred until a white slurry was obtained (30 minutes). Solid anhydrous sodium sulfate (100 g) was added to the reaction. After stirring for an additional 15 minutes, the solid was filtered off and thoroughly rinsed with diethyl ether. The filtrate was then concentrated under vacuum. The product was purified by distillation through a 20-cm Widmer column. 304 g of the desired alcohol were obtained (1.78 mol, 89% yield).

B.p.=52° C./0.001 mbar $^{13}$C-NMR: 136.90 (s); 136.06 (s); 134.68 (s); 128.83 (d); 128.79 (d); 124.98 (d); 69.00 (t); 21.13 (q); 15.29 (q).

$^{1}$H-NMR: 7.13 (m, 4 H); 6.46 (b.s, 1 H); 4.13 (s, 2 H); 2.32 (s, 3 H); 1.87 (s, 3 H).

1-methyl-4-{(1E)-[2-methyl-3-[(2-methyl-2-propenyl]oxy]-1-propenyl}benzene (2E)-2-methyl-3-(4-methylphenyl)-2-propenol (81.1 g, 0.5 mol) was dissolved in dry THF (800 ml) under nitrogen. The solution was cooled in an ice-water bath, and solid potassium tert-butoxide (71.6 g, 0.625 mol) was added portion-wise. The reaction was warmed up to room temperature and tetra-n-butyl ammonium iodide (9.4 g, 0.025 mol) was added. After 15 minutes, the reaction was cooled in an ice-water bath, and treated, drop-wise, with methallyl chloride (101 g, 1 mol) over a 30-minutes period. The reaction was warmed up to room temperature and stirred overnight. The reaction was treated with a saturated aqueous ammonium chloride solution (250 ml). Sodium bisulfite (30 g) was added and the mixture shaken vigorously. The phases were separated. The organic phase was washed with brine (500 ml). Each aqueous phase was extracted with ethyl acetate (500 ml). Combined extracts were dried over sodium sulfate. The desired product was purified by a short-path distillation. 110 g of the desired compound were obtained (0.5 mol, 100%).

B.p.=120° C./0.001 mbar)

$^{13}$C-NMR: 142.35 (s); 136.06 (s); 134.70 (s); 134.48 (s); 128.83 (d); 126.83 (d); 112.13 (t); 76.17 (t); 73.76 (t); 21.15 (q); 19.58 (q); 15.52 (q).

$^{1}$H-NMR: 7.15 (m, 4 H); 6.48 (b.s, 1 H); 5.00 (b.s, 1 H); 4.90 (broad s, 1 H); 3.98 (s, 2 H); 3.91 (s, 2 H); 2.32 (s, 3 H); 1.90 (s, 3 H); 1.78 (s, 3 H).

1-[(1E)-3-(Allyloxy)-2-methyl-1-propenyl]-4-methylbenzene

Solid potassium tert-butylate (47 g, 0.411 mol) was added portion-wise to a solution of E-3-(4-methylphenyl)-2-methyl-2-propen-1-ol (68.05 g, 0.420 mol) in dry THF (800 ml) at room temperature under nitrogen (exothermic to 30° C.). After 1 more hour at room temperature, the reaction was cooled to 5° C. and tetra butyl ammonium iodide (7.9 g, 0.021 mol) was added followed by allyl bromide (102.65 g, 0.840 mol) drop-wise. The reaction was warmed up to room temperature overnight and poured onto water (800 ml). The reaction was extracted twice with ethyl acetate. Each organic phase was washed with water and brine. Combined extracts were dried over solid anhydrous sodium sulfate. The solid was filtered off, rinsed with diethyl ether and the solvents were removed under vacuum. The product was purified by distillation under vacuum through a 20-cm Widmer column. 79 g of the desired product were obtained (yield=93%).

B.P.=82° C./0.001 mbar $^{13}$C-NMR: 136.07 (s), 134.91 (d), 134.66 (s), 134.38 (s), 128.82 (d), 126.89 (d), 116.90 (t), 76.39 (t), 70.78 (t), 21.14 (q), 15.51 (q).

$^{1}$H-NMR: 7.15 (m, 4H), 6.47 (s, 1H), 6.00-5.90 (m, 1H), 5.30 (m, 1H), 5.18 (m, 1H), 4.00 (m, 4H), 2.32 (s, 3H), 1.88 (s, 3H).

General Procedure for the Preparation of 3-aryl-2-alkylpropenals

The aldehyde (280 mmol) was added dropwise to a mixture of the arylaldehyde, (330 mmol), methanol (100 ml) and 20% aqueous KOH (8 g, 28.6 mmol) at room temperature. The mixture then was heated at 40° C. for one hour. The mixture was allowed to cool to room temperature and 2.0 g of acetic acid was added. The methanol was removed on a rotary evaporator. The residue was diluted with ethyl ether and washed with water. The organic phase was dried ($MgSO_4$), filtered and concentrated. Fractional distillation (Vigreux column, 50 mm) yielded the (E)-3-aryl-2-alkylpropenals as pale yellow liquids.

(E)-3-(4-ethylphenyl)-2-methyl-2-propenal $^{1}$H-NMR: 1.26 (t, J=7.6, 3H), 2.08 (S, 3H), 2.69 (q, J=7.6, 2H), 7.22 (s, 1H), 7.28 (d, J=8.0, 2H), 7.47 (d, J=8.0, 2H), 9.56 (s, 1H)

$^{13}$C-NMR: 10.9 (q), 15.3 (q), 28.8 (t), 128.3 (d), 130.3 (d), 132.7 (s), 137.5 (s), 146.3 (s), 150.0 (d), 195.6 (d).

(E)-2-ethyl-3-(4-methylphenyl)-2-propenal $^{1}$H-NMR: 1.13 (t, J=7.5, 3H), 2.39 (s, 3H), 2.56 (q, J=7.5, 2H), 7.15 (s, 1H), 7.24 (d,
J=8.0, 2H), 7.41 (d, J=8.0, 2H), 9.51 (s, 1H)

$^{13}$C-NMR: 12.8 (q), 18.0 (t), 21.4 (q), 129.6 (d), 129.8 (d), 132.1 (s), 140.0 (s), 143.6 (s), 149.8 (d), 195.6 (d)

(E)-2-Ethyl-3-(4-methylphenyl)-2-propen-1-ol $LiAlH_4$ (1.15 g, 30 mmol) was added to a diethyl ether (100 ml) solution of (E)-2-ethyl-3-(4-methylphenyl)-2-propenal (5.0 g, 28.7 mmol) cooled in a −78° C. cold bath.

The mixture was removed from the cold bath and stirred for 2 hours at room temperature. After placing the mixture in a 0° C. bath, 1.5 ml of water, 4.5 ml of 3M aqueous NaOH, and another 1.5 ml of water were added. A white precipitate developed, and the mixture was stirred for 30 minutes at room temperature. After filtration, the solution was dried ($NaSO_4$), filtered and concentrated. Kugelrohr distillation of the residue (110-120° C., 0.02 mbar) yielded the product as a colorless oil.

$^{1}$H-NMR: 1.10 (t, J=7.6, 3H), 2.03 (s, 1H), 2.32 (q, J=7.6, 2H), 2.33 (s, 3H), 4.20 (s, 2H), 6.45 (s, 1H), 7.10-7.16 (m, 4H);

$^{13}$C-NMR: 13.0 (q), 21.1 (q), 21.7 (t), 66.7 (t), 124.9 (d), 128.5 (d), 128.9 (d), 134.6 (s), 136.1 (s), 142.8 (s);

(E)-2-Methyl-3-(4methylphenyl)-2-propenyl Formate

A mixture of acetic anhydride (6.3 g, 62 mmol) and formic acid (2.84 g, 62 mmol) was heated at 40° C. for 30 min and then allowed to cool to room temperature. (E)-2-methyl-3-(4-methylphenyl)-2-propen-1-ol (5 g, 30 9 mmol) was added, and the solution was stirred for one day. It then was diluted with diethyl ether (200 ml) and washed with water (twice 100 ml). The organic phase was dried (MgSO4), filtered and concentrated. The product was purified by silica gel flash chromatography (hexane/EtOAc=98:2) followed by Kugelrohr distillation (85° C., 0.02 mbar) yielding 1.6 g (8 4 mmol, 27% yield) of the product as a colorless oil.

$^{1}$H-NMR: 1.90 (t, J=1.3, 3H), 2.34 (s, 3H), 4.71 (s, 2H), 6.52 (b.s, 1H), 7.13-7.18 (m, 4H), 8.14 (s, 1H);

$^{13}$C-NMR: 15.6 (q), 21.2 (q), 69.9 (t), 128.8 (d), 128.9 (d), 129.1 (d), 131.2 (s), 133.9 (s), 136.7 (s), 160.9 (d);

(E)-3-(4-Ethylphenyl)-2-methyl-2-propenyl Acetate (E)-3-(4-Ethylphenyl)-2-methyl-2-propen-1-ol (4.6 g, 26 1 mmol, obtained by LiAlH4 reduction of (E)-3-(4-ethylphenyl)-2-methyl-2-propenal as described for (E)-2-Ethyl-3-(4-methylphenyl)-2-propen-1-ol) was added to a mixture of acetic anhydride (4.0 g, 39 mmol), pyridine (3.5 g, 44 mmol) and DMAP (0.46 g, 3.7 mmol) in 50 ml of dichloromethane. The mixture was stirred for 20 hours at room temperature. The dichloromethane was removed on a rotary evaporator, and the residue dissolved in EtOAc. This solution was washed with aqueous 10% HCl, aqueous 10% NaOH, and saturated aqueous NaCl. The organic phase was dried (MgSO4), filtered and concentrated. The product was purified by silica gel flash chromatography (hexane/EtOAc=80:20) followed by Kugelrohr distillation (140-160° C., 0.05 mbar) yielding 3.9 g (17.9 mmol, 69% yield) of the product as a colorless oil.

$^{1}$H-NMR: 1.23 (t, J=7.6, 3H), 1.89 (d, J=1.2, 3H), 2.10 (s, 3H), 2.64 (q, J=7.6, 2H), 4.63 (s, 2H), 6.50 (b.s, 1H), 7.15-7.21 (m, 4H);

$^{13}$C-NMR: 15.5 (q), 15.6 (q), 21.0 (q), 28.6 (t), 70.4 (t), 127.7 (d), 128.4 (d), 128.9 (d), 132.0 (s), 134.4 (s), 142.9 (s), 170.9 (s)

(1-Methyl-2-p-tolylcyclopropyl)methanol n-Butyllithium (1.6 molar in hexanes; 33.2 ml; 53 1 mmol) was added dropwise to (2E)-2-methyl-3-(4-methylphenyl)-2-propen-1-ol (8.61 g, 53 1 mmol) in dry diethyl ether (120 ml) at 0° C. under nitrogen. After 10 minutes, dibromomethane (46.6 g; 265 mmol) was added dropwise, followed, after 15 minutes, by t-butyl magnesium chloride (2 molar in diethyl ether; 133 ml; 265 mmol). The reaction was then slowly warmed up to room temperature and stirred overnight. It was then cooled into an ice-water bath and a saturated aqueous ammonium chloride solution (300 ml) was added (initially dropwise, exothermic). After warming to room temperature, diethyl ether (200 ml) was added and the mixture shaken vigorously. The organic phase was washed with water (600 ml) and brine (300 ml). Each aqueous phase was re-extracted with diethyl ether (300 ml). Combined extracts were dried over solid anhydrous sodium sulfate. The product was purified by column chromatography on silica gel (heptane/ethyl acetate 5:1 to 2:1) followed by bulb-to-bulb distillation (120° C./1 mbar). 2.21 g of 90% pure material was obtained as a colorless liquid (11.3 mmol; 21%).

$^{1}$H-NMR: 7.08 (m, 4H); 3.52 (broad s, 2H); 2.32 (s, 3H); 1.98 (m, 1H); 1.72 (broad s, 1H); 0.90-0.79 (m, 2H); 0.87 (s, 3H).

$^{13}$C-NMR: 135.71 (s); 135.33 (s); 128.98 (d); 128-71 (d); 71.73 (t); 26.36 (d); 24.96 (s); 21.00 (q); 15.78 (q); 15.14 (t).

Example 2

Preparation of a Perfuming Composition

A perfuming composition, of the linden type, was prepared by admixing the following ingredients:

| Ingredient | Parts by weight |
|---|---|
| Octyl acetate | 350 |
| Dodecyl acetate | 1500 |
| Hydratropic alcohol | 1450 |
| 10% * Nonadienol | 20 |
| Acacia essential oil | 800 |
| Hedione ® [1)] | 650 |
| Ionone alpha | 20 |
| Iralia ® [2)] Total | 40 |
| Lilial ® [3)] | 2500 |
| Lyral ® [4)] | 1000 |
| 10% * Neobutenone ® [5)] Alpha | 30 |
| Methyl octyn carbonate | 40 |
| 1% * Nonadienal | 50 |
| 2,4-Dimethyl-3-cyclohexene-1-carbaldehyde [6)] | 50 |
| | 8500 |

* in dipropyleneglycol

[1)] methyl cis-dihydrojasmonate; origin: Firmenich SA, Geneva, Switzerland

[2)] mixture of methylionones isomers; origin: Firmenich SA, Geneva, Switzerland

[3)] 3-(4-tert-butylphenyl)-2-methylpropanal; origin: Givaudan-Roure SA, Vernier, Switzerland

[4)] 4/3-(4-hydroxy-4-methylpentyl)-3-cyclohexene-1-carbaldehyde; origin: International Flavors & Fragrances, USA

[5)] 1-(5,5-dimethyl-1-cyclohexen-1-yl)-4-penten-1-one; origin: Firmenich SA, Geneva, Switzerland

[6)] origin: Firmenich SA, Geneva, Switzerland

The addition of 1500 parts by weight of (2E)-2-methyl-3-(4-methylphenyl)-2-propen-1-ol to the above-described composition imparted to the letter a linden blossom connotation much more natural.

When instead of the invention's compound was used the same amount of 3-(1,3-benzodioxol-5-yl)-2-methylpropanal (Arctander n° 2110), the effect was much more anisic and water, i.e. different from the one of the present invention).

When instead of the invention's compound was used the same amount of Canthoxal (3-(4-methoxyphenyl)-2-methylpropanal, of International Flavors & Fragrances, USA), the effect was much more mimosa and acacia, i.e. different from the one of the present invention.

When instead of the invention's compound was used the same amount of α-methylcinnamic alcohol (Arctander n° 1950), the effect was definitively not floral, but cinnaminic, i.e. different from the one of the present invention.

Example 3

Preparation of a Perfuming Composition

A perfuming composition for woman, of the floral-musky type, was prepared by admixing the following ingredients:

| Ingredient | Parts by weight |
|---|---|
| Styrallyl acetate | 10 |
| Hexylcinnamic aldehyde | 300 |
| 10% * Nonalactone gamma | 30 |
| Bergamote essential oil | 300 |
| 10% * 7-Methyl-2H,4H-1,5-benzodioxepin-3-one [1)] | 40 |
| Cardamom essential oil | 60 |
| 4-Cyclohexyl-2-methyl-2-butanol | 200 |
| Cis-2-pentyl-1-cyclopentanol [1)] | 100 |
| Dimethyl Benzyl Carbinyl Butyrate | 10 |
| Hedione ® [2)] HC | 600 |
| 10% * Isobutylquinoleine | 20 |
| Jasmal ® [3)] | 200 |
| 10% * Jasmine lactone | 25 |
| Methyl jasmonate | 250 |
| 10% * 2,6-Dimethyl-5-heptanal | 20 |
| 10% * Nonenol | 20 |

-continued

| Ingredient | Parts by weight |
|---|---|
| Dextro trans-1-(2,2,6-trimethyl-1-cyclohexyl)-3-hexanol [1)] | 10 |
| Oliban essential oil | 40 |
| Patchouli essential oil | 10 |
| (Z)-3-hexen-1-ol | 5 |
| Romandolide ® [4)] | 600 |
| Rose Bulgare essential oil | 50 |
| Benzyl salicylate | 320 |
| (Z)-3-hexen-1-ol salicylate | 50 |
| (Z)-3-hexen-1-ol tiglate | 20 |
| (+)-(1S,2S,3S)-2,6,6-trimethyl-bicyclo[3.1.1]heptane-3-spiro-2'-cyclohexen-4'-one [1)] | 210 |
| | 3500 |

* in dipropyleneglycol 1) origin: Firmenich SA, Geneva, Switzerland 2) high Cis methyl cis-dihydrojasmonate; origin: Firmenich SA, Geneva, Switzerland 3) mixture of 1,3-nonanediyl diacetate and tetrahydro-3-pentyl-4(2h)-pyranyl acetate; origin: International Flavors & Fragrances, USA 4) (1S,1'R)-[1-(3',3'-Dimethyl-1'-cyclohexyl)ethoxycarbonyl]methyl propanoate; origin: Firmenich SA, Geneva, Switzerland The addition of 900 parts by weight of (2E)-2-methyl-3-(4-methylphenyl)-2-propen-1-ol to the above-described composition imparted to the above feminine perfume a character more floral, more powdery, evoking the lilly of the valley and linden.

When instead of the invention's compound was used the same amount of 3-(1,3-benzodioxol-5-yl)-2-methylpropanal or Canthoxal, the effect was much more anisic and balsamic, evoking the acacia odor, i.e. different from the one of the present invention. When instead of the invention's compound was used the same amount of α-methylcinnamic alcohol, the effect was definitively not floral, but of the oriental type, i.e. different from the one of the present invention.

What is claimed is:

1. A method to confer, enhance, improve or modify the odor properties of a perfuming composition or of a perfumed article, which method comprises adding to said composition or article an effective amount of at least a compound of formula (II) to impart anisic and floral odor notes, wherein formula (II) is:

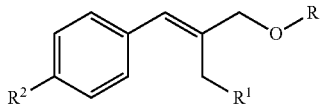

(II)

in the form of any one of its stereoisomers or a mixture thereof, and wherein

R represents a hydrogen atom, a $C_{1-4}$ alkyl or alkenyl group or a formyl or acetyl group;

$R^1$ represents a hydrogen atom or a methyl group; and $R^2$ represents a methyl, ethyl or methoxy group.

2. The method according to claim 1, wherein R represents a hydrogen atom, an allyl group, a methyl group or a formyl or acetyl group.

3. The method according to claim 1, wherein $R^1$ represents a hydrogen atom.

4. The method according to claim 1, wherein $R^2$ represents a methyl or methoxy group.

5. The method according to claim 1, wherein said compounds (I) are $C_{11}$-$C_{14}$ compounds.

6. The method according to claim 1, wherein said compound (I) is (2E)-2-methyl-3-(4-methylphenyl)-2-propen-1-ol, (1-methyl-2-p-tolyl-cyclopropyl) methanol or 1-[(1E)-3-(allyloxy)-2-methyl-1-propenyl]-4-methylbenzene.

7. A perfuming ingredient in the form of a composition comprising i) at least one compound of formula (II), as defined in claim 1;

ii) at least one ingredient selected from the group consisting of a perfumery carrier and a perfumery base; and iii) optionally at least one perfumery adjuvant.

8. A perfuming consumer product comprising:

i) at least one compound of formula (II), as defined in claim 1; and ii) a perfumery consumer base.

9. A perfuming consumer product according to claim 8, wherein the perfumery consumer base is a perfume, a fabric care product, a bodycare product, an air care product or a home care product.

10. A perfuming consumer product according to claim 8, wherein the perfumery consumer base is a fine perfume, a cologne, an after-shave lotion, a liquid or solid detergent, a fabric softener, a fabric refresher, an ironing water, a paper, a bleach, a shampoo, a coloring preparation, a hair spray, a vanishing cream, a deodorant or antiperspirant, a perfumed soap, shower or bath mousse, oil or gel, a hygiene product, an air freshener, a "ready to use" powdered air freshener, a wipe, a dish detergent or hard-surface detergent.

* * * * *